US007378141B2

(12) United States Patent
Polegato Moretti

(10) Patent No.: US 7,378,141 B2
(45) Date of Patent: May 27, 2008

(54) CLOTHING VENTILATION DEVICE ALLOWING THE HUMAN BODY TO BREATHE

(75) Inventor: Mario Polegato Moretti, Crocetta del Montello (IT)

(73) Assignee: Geox S.p.A., Montebelluna (IT)

( * ) Notice: Subject to any disclaimer, the term of this patent is extended or adjusted under 35 U.S.C. 154(b) by 6 days.

(21) Appl. No.: 10/239,637

(22) PCT Filed: Jan. 18, 2002

(86) PCT No.: PCT/EP02/00472

§ 371 (c)(1),
(2), (4) Date: Sep. 24, 2002

(87) PCT Pub. No.: WO02/058494

PCT Pub. Date: Aug. 1, 2002

(65) Prior Publication Data

US 2003/0104734 A1 Jun. 5, 2003

(30) Foreign Application Priority Data

Jan. 24, 2001 (IT) ..... PD01A000016

(51) Int. Cl.
*B32B 3/10* (2006.01)
*A41B 13/00* (2006.01)
*A41D 3/04* (2006.01)

(52) U.S. Cl. ..... 428/131; 428/137; 428/138; 2/69; 2/87

(58) Field of Classification Search ..... 428/131, 428/137, 138; 2/69, 87, 458, 93, DIG. 1, 2/135

See application file for complete search history.

(56) References Cited

U.S. PATENT DOCUMENTS

| | | | | |
|---|---|---|---|---|
| 2,781,820 | A | 2/1957 | Rogers | |
| 3,761,962 | A | 10/1973 | Myers | |
| 4,685,155 | A * | 8/1987 | Fingerhut et al. | 2/272 |
| 5,472,760 | A * | 12/1995 | Norvell | 428/71 |
| 6,308,344 | B1 * | 10/2001 | Spink | 2/458 |
| 6,341,384 | B1 * | 1/2002 | Hayes | 2/458 |

FOREIGN PATENT DOCUMENTS

| | | |
|---|---|---|
| EP | 0 329 411 | 8/1989 |
| EP | 0 397 998 | 11/1990 |
| FR | 511 152 | 12/1920 |
| HU | P0004666 A | 9/1997 |
| WO | WO 99/12436 | 3/1999 |
| WO | 01 01803 | 1/2001 |

* cited by examiner

*Primary Examiner*—Patricia L Nordmeyer
(74) *Attorney, Agent, or Firm*—Oblon, Spivak, McClelland, Maier & Neustadt, P.C.

(57) ABSTRACT

A ventilation device to be applied to items of clothing, which includes an assembly with through holes, which is composed of a band of material that is at least partially transparent and impermeable and is configured to be arranged externally. A layer is provided to be placed in view and is made of natural or synthetic fabric or natural or synthetic leather. At least one layer of adhesive polymeric material mutually joins the outer band and the layer, between which it is sandwiched. A membrane which is impermeable to water and permeable to vapor, provided to be arranged internally, is sealed at least perimetrically to the assembly on the side of the layer to be placed in view.

11 Claims, 2 Drawing Sheets

CLOTHING VENTILATION DEVICE ALLOWING THE HUMAN BODY TO BREATHE

TECHNICAL FIELD

The present invention relates to a ventilation device to be applied to items of clothing in order to allow the human body to breathe.

The invention also relates to the method for producing the device.

BACKGROUND ART

It is known that people wear shoes and clothing mainly to protect themselves from weather and the cold.

Depending on the external temperature and on the environmental conditions, it is necessary to resort to various "layers" of clothing in order to adapt the body to the surrounding environment.

This protection system allows, in particular, to easily adapt the body to the thermal variations that can occur simply by adding or removing one or more layers of clothing.

The human body inherently has a series of "mechanisms" that allow it to adapt thermally to the surrounding environment.

In case of overheating, the body, in fact, reacts by increasing perspiration, which by evaporating ensures a natural lowering of the temperature of the body.

However, if the water vapor is unable to escape from the layers of clothing in which the human body is wrapped, humidity increases and the vapor condenses, returning to the liquid state of perspiration and thus wetting the clothes starting from the ones that constitute the first layer (underwear).

The only solution to this drawback is to replace as quickly as possible the wet item with a dry one, with the risk, however, of subjecting the body to sudden chilling.

A breathable item of clothing has recently been devised which is disclosed in Italian Patent Application PD99A000149 of Jul. 6, 1999 and in the corresponding WO 01/01803 A1 and comprises a protective outer enclosure with an internal layer that affects at least part of the extension of said outer enclosure and defines internally an interspace.

The inner layer has, at least at the regions of the human body where sweat forms most abundantly, holes for access to said interspace for the vapor produced by sweating.

The inner layer and the outer enclosure have, in the top regions of the item, holes for the evacuation of the vapor that is conveyed by a "stack effect" inside said interspace, combined with means that hold out water, impurities or other substances.

The means that hold out water is constituted by a membrane that is permeable to vapor and/or air, impermeable to water, arranged in the upper regions where the vapor exit holes are formed, and interposed between said outer enclosure and said inner layer.

As an alternative, the means that hold out the water is constituted by a ventilation element that is provided with means for fixing to the fabric of an item of clothing at an appropriately provided opening.

The ventilation element has, at the part to be arranged externally, an orientation that slopes from the center toward the peripheral region and a top opening.

An external protective dome, raised substantially from the ventilation element, is fixed perimetrically thereto and has, in a position other than the central one, at least one hole that is not aligned with the central opening.

Although said means that hold out water have been found to be functional, even in the other embodiments disclosed in Italian Patent Application PD99A000149 of Jul. 6, 1999 and in the corresponding WO 01/01803 A1, they have been found to have drawbacks, including difficulties in manufacture and/or production, but most of all their resulting or inherent color is hardly comparable to the color of the item, and this causes considerable problems in terms of visual impact, which is fundamental for marketability.

An equally important factor is high cost.

DISCLOSURE OF THE INVENTION

The aim of the present invention is therefore to provide a ventilation device of the type suitable to be applied to items of clothing that allows breathing, at the same time ensuring the fullest impermeability to water and a visual impact that is distinctly better than the impact obtained with known devices.

Within this aim, an object to be achieved with the present invention is to provide a ventilation device that allows in every respect the natural thermoregulation of the human body.

Another object is to obtain a ventilation device that is structurally very simple to provide.

Another object of the present invention is to provide a ventilation device that is easy to apply to any type of item of clothing.

This aim and these and other objects that will become better apparent hereinafter are achieved by a ventilation device to be applied to items of clothing, characterized in that it comprises:

- an assembly with through holes, composed of a band of material that is at least partially transparent and impermeable and is provided to be arranged externally, a layer provided to be placed in view and made of natural or synthetic fabric, natural or synthetic leather or equivalents, at least one layer of adhesive polymeric material for joining one another said outer band and said layer to be placed in view, between which is inserted:
- a membrane which is impermeable to water and permeable to vapor, provided for being arranged internally, and sealed at least perimetrically to said assembly on the side of said layer to be placed in view.

Advantageously, between said assembly and said membrane there is a layer of open-cell expanded plastic material.

BRIEF DESCRIPTION OF THE DRAWINGS

Further characteristics and advantages of the present invention will become better apparent from the description of an embodiment thereof illustrated only by way of non-limitative example in the accompanying drawings, wherein.

WAYS TO CARRYING OUT THE INVENTION

Figure 1:
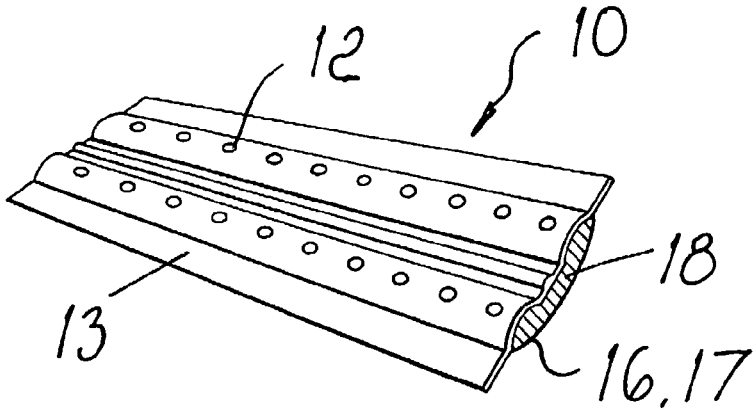
FIG. 1 is a perspective view of a portion of the device according to the invention.
Figure 2:
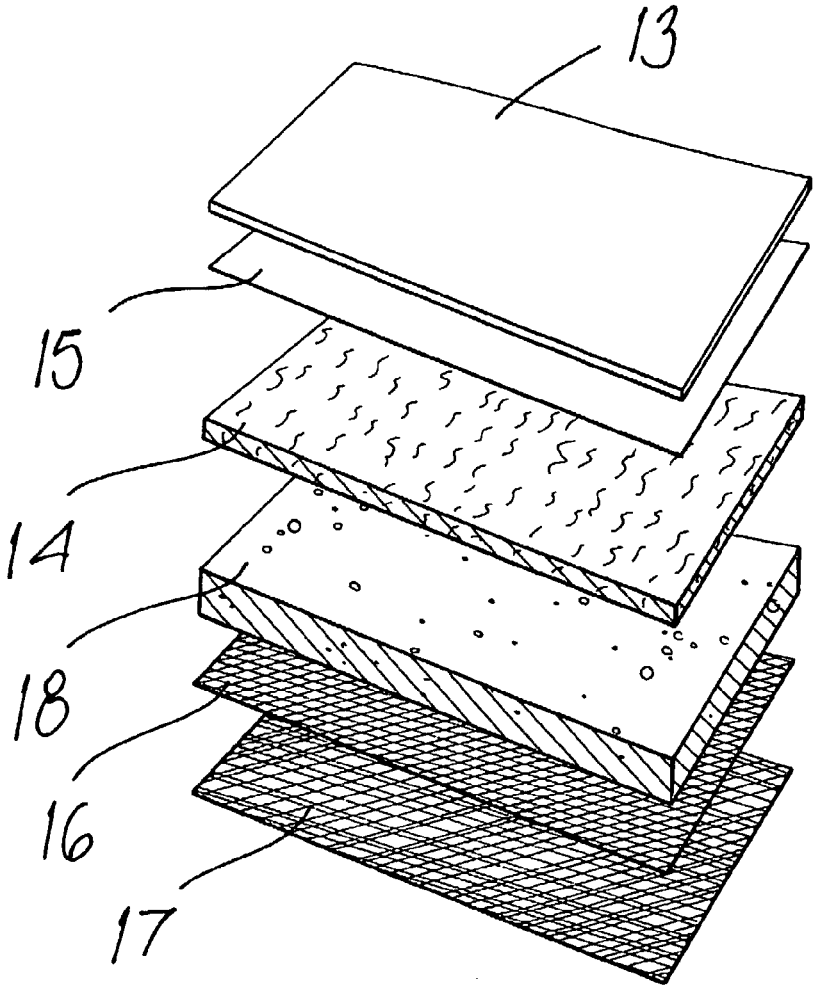
FIG. 2 is an exploded perspective view of the components of the device of FIG. 1.

With reference to the figures, a preferred embodiment of a ventilation device according to the present invention is generally designated by the reference numeral 10.

The ventilation device 10 comprises an assembly 11 with through holes 12 (in order to allow the passage of vapor) composed of a band 13 made of at least partially transparent and impermeable material to be arranged externally, a layer 14 to be placed in view, preferably of the same type as the one that constitutes the item of clothing (not shown) on which the device is applied, therefore for example natural or synthetic fabric, natural or synthetic leather or equivalents, joined by applying heat to said band 13 by means of at least one layer 15 made of heat-sealing polymeric material inserted between them.

The layer 15 preferably has a thickness in the order of 0.1 mm and is made of a material that is compatible with the material of the band 11 and with the requirements of, for example, high-frequency bonding (cited hereafter) and therefore with a low melting point.

Advantageously, in this case the material can be constituted by PU.

As an alternative, the layer 15 can be constituted by a coating or spread of an adhesive that can be reactivated by pressure or heat.

The function of the band 13 is also to avoid unraveling of the fabric of the layer 14 to be placed in view after the provision of the holes 12.

The band must also be made of a material that is compatible with high-frequency bonding, for example PVC, if this type of bonding is subsequently adopted.

A membrane 16 that is impermeable to water and permeable to vapor (such as expanded PTFE and/or hydrophilic polymer), to be arranged internally, is sealed at least perimetrically by high-frequency bonding to the assembly 11 on the side of said layer 14.

Alternatively, sealing can also be performed by thermoformation (hot pressing in molds) or with another suitable means.

Conveniently, the membrane 16 can be laminated together with a supporting layer (mesh) 17, which in this case is shown at the inner part but can also be arranged toward the outside.

The membrane 16 can also be laminated with protective materials (not shown), which are in any case placed toward the inside.

Advantageously, between the layer 14 to be placed in view and the membrane 16 there is a layer 18 made of open-cell expanded plastic material, which is capable of creating a space for separating them in order to allow better passage of the vapor.

The layer 18 can also be used to produce a padding effect and, through the high-frequency bonding that produces compressed and expanded regions, provide on the outside decorations, designs, markings, et cetera.

Figure 3:
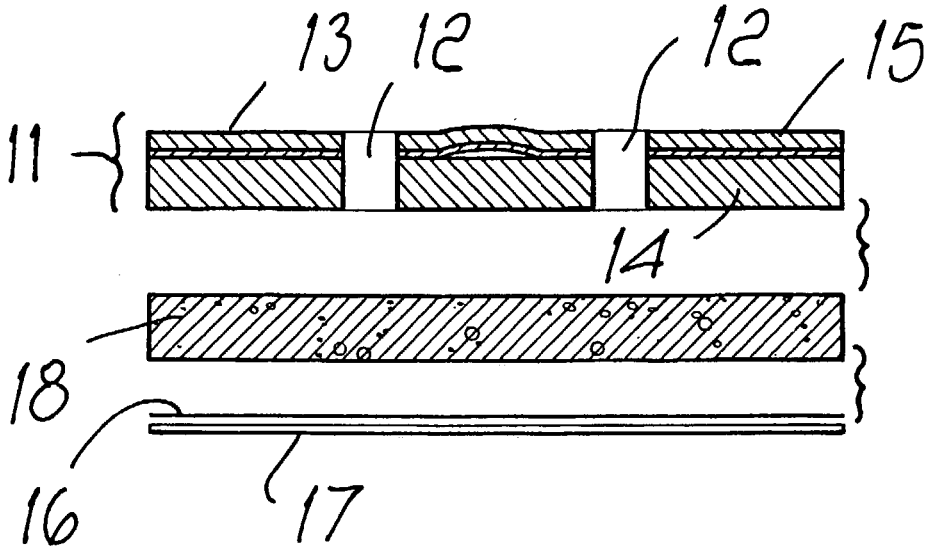
FIG. 3 is a sectional view of the device in a step of its production.
Figure 4:
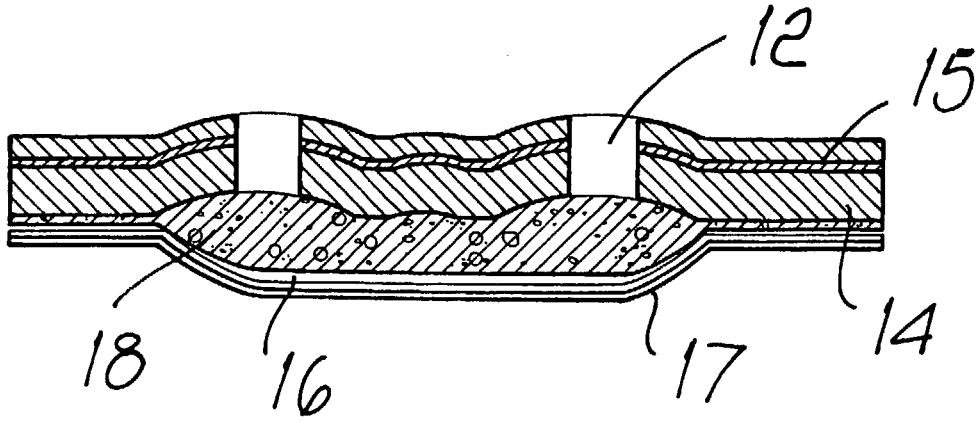
FIG. 4 is a sectional view of the device in a step of its production that follows the step of FIG. 3.

As regards the production process, it provides for the following steps:

- the band 13 is coupled by continuous or discontinuous thermoformation to the layer 14, to be placed in view, by means of the layer 15;
- the through holes 12 are formed through the assembly 11, which has the appearance shown in FIG. 3;
- the membrane 16, optionally together with the mesh 17, is joined to the assembly 11 (optionally with the layer 18 inserted between them), by high-frequency bonding (FIG. 4).

In practice it has been found that the present invention has achieved more than satisfactorily the intended aim and objects.

A considerable advantage has been achieved by the present invention in that a ventilation device has been provided which is suitable to be applied to items of clothing, and allows maximum breathing and at the same time ensures the fullest impermeability to water and is therefore particularly suitable for all items in which waterproofness is a fundamental prerogative.

It should be noted that the band 13 (which is transparent) places the layer 14 in view, and this gives the assembly an excellent visual impact.

Another very important advantage has been achieved in that a ventilation device has been provided which ensures, in every respect, the natural thermoregulation of the human body.

Moreover, one should consider the fact that the ventilation device devised with the present invention is structurally very simple to provide.

It is also worth pointing out the fact that the ventilation device that has been devised is easy to apply to any type of item of clothing.

All the details may further be replaced with other technically equivalent elements.

The materials used, so long as they are compatible with the contingent use, as well as the dimensions, may be any according to requirements.

The disclosures in Italian Patent Application No. PD2001A000016 from which this application claims priority are incorporated herein by reference.

The invention claimed is:

1. A ventilation device to be applied to items of clothing, comprising:

an outer band formed of a material that is at least partially transparent and impermeable, a visible layer to be placed in view, and at least one layer of adhesive polymeric material arranged between said outer band and said layer to join said outer band and said layer to form an assembly such that said layer is placed in view by said outer band that is at least partially transparent;

a membrane which is impermeable to water and permeable to vapor and sealed at least perimetrically to said assembly on a side of said layer opposite said outer band such that vapor may pass through said membrane toward said assembly and water may not pass through said membrane in a direction from said assembly; and through holes extending through said outer band, said layer of adhesive polymeric material, and said layer placed in view by said outer band, wherein vapor passes from said membrane through said through holes.

2. The ventilation device according to claim 1, wherein between said assembly and said membrane is arranged a layer of open-cell expanded plastic material.

3. The ventilation device according to claim 1, wherein said layer of adhesive polymeric material is made of heat-sealing material.

4. The ventilation device according to claim 3, wherein said layer of heat-sealing material has a thickness of approximately 0.1 mm.

5. The ventilation device according to claim 3, wherein said outer band is made of PVC.

6. The ventilation device according to claim 1, wherein said layer of adhesive polymeric material comprises a spread or coating of an adhesive configured to be reactivated by pressure or heat.

7. The ventilation device according to claim 1, wherein a thermoformed element seals said membrane.

8. The ventilation device according to claim 1, wherein said membrane is laminated together with a supporting layer.

9. The ventilation device according to claim 8, wherein said supporting layer is a mesh.

10. The ventilation device according to claim 1, wherein said membrane is laminated with at least one protective material.

11. A ventilation device applied to an item of clothing, comprising:

an outer band formed of a material that is at least partially transparent and impermeable, a layer to be placed in view and being of the same type as said item of clothing on which said ventilation device is applied, and at least one layer of adhesive polymeric material arranged between said outer band and said layer to join said outer band and said layer to form an assembly such that said layer is placed in view by said outer band that is at least partially transparent, a membrane which is impermeable to water and permeable to vapor and scaled at least perimetrically to said assembly on a side of said layer opposite said outer band such that vapor may pass through said membrane toward said assembly and water may not pass through said membrane in a direction from said assembly; and through holes extending through said outer band, said layer of adhesive polymeric material, and said layer placed in view by said outer band, wherein vapor passes from said membrane through said through holes.

* * * * *